US007937894B2

(12) United States Patent
Renke et al.

(10) Patent No.: US 7,937,894 B2
(45) Date of Patent: May 10, 2011

(54) WINDOW GLASS DOWN STOP STABILIZER FOR A VEHICLE DOOR

(75) Inventors: David T. Renke, Macomb, MI (US); Gavin J. Brownlie, Jr., Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 289 days.

(21) Appl. No.: 12/250,583

(22) Filed: Oct. 14, 2008

(65) Prior Publication Data

US 2010/0088968 A1 Apr. 15, 2010

(51) Int. Cl.
*E06B 3/00* (2006.01)

(52) U.S. Cl. ..... 49/506; 49/348; 49/414; 49/415; 49/419; 49/436

(58) Field of Classification Search ..... 49/414, 49/415, 416, 417, 418, 419, 423, 436, 506, 49/348, 349

See application file for complete search history.

(56) References Cited

U.S. PATENT DOCUMENTS

| | | | | | |
|---|---|---|---|---|---|
| 1,858,602 | A * | 5/1932 | Shrauger | 49/466 |
| 2,047,047 | A * | 7/1936 | Wirth | 49/420 |
| 2,379,927 | A * | 7/1945 | Roethel | 49/375 |
| 2,481,536 | A * | 9/1949 | Roethel | 49/417 |
| 2,752,185 | A * | 6/1956 | Coppola | 49/415 |
| 3,566,540 | A * | 3/1971 | Hewitt | 49/417 |
| 4,669,221 | A * | 6/1987 | Ugawa et al. | 49/352 |
| 5,018,305 | A * | 5/1991 | Kuki et al. | 49/348 |
| 6,079,159 | A * | 6/2000 | Leonardi | 49/415 |
| 6,299,236 | B1 * | 10/2001 | Praud et al. | 296/146.7 |

* cited by examiner

*Primary Examiner* — Jerry Redman

(57) ABSTRACT

A vehicle door is disclosed that has a movable window and a window regulator including a regulator rail and a regulator slider slidably mounted on the regulator rail and engaging the window for movement between a closed position and a fully open position. The door also has a window down stop stabilizer assembly including a position detecting assembly that detects when the window is in the fully open position, a bumper movable between a first position spaced from the window and a second position in contact with the window, and a bumper actuator that moves the bumper into and out of contact with the window. When the window is in the fully open position, the bumper actuator will move the bumper into the second position and when the window is not in the fully open position, the bumper actuator will move the bumper into the first position.

8 Claims, 3 Drawing Sheets

WINDOW GLASS DOWN STOP STABILIZER FOR A VEHICLE DOOR

BACKGROUND OF INVENTION

The present invention relates generally to movable windows in vehicle doors and more particularly to a stabilizer for the movable window in these doors.

Automotive vehicles commonly have movable window glass in their doors, and the doors can be opened and closed with the windows in the open (down) position. One concern that arises is window rattle that may occur when the door is closed with the window in the full open position. Thus, some have developed ways to stabilize the glass, such as below belt glass run channel brackets and additional bumpers and seal stuffers. While these solutions allow for improved door closing sound quality, they are less desirable for some vehicle applications, and may be more costly than is desirable.

SUMMARY OF INVENTION

An embodiment contemplates a vehicle door having a movable window and a window regulator including a regulator rail and a regulator slider slidably mounted on the regulator rail and engaging the window for movement between a closed position and a fully open position. The embodiment also contemplates a window down stop stabilizer assembly including a position detecting assembly that detects when the window is in the fully open position, a bumper mounted adjacent to the window and movable between a first position spaced from the window and a second position in contact with the window, and a bumper actuator that moves the bumper into and out of contact with the window. When the window is in the fully open position, the bumper actuator will move the bumper into the second position and when the window is not in the fully open position, the bumper actuator will move the bumper into the first position.

An embodiment contemplates a method of stabilizing a window in a vehicle door when the window is in a fully open position, the method comprising the steps of: moving the window toward a fully open position; detecting when the window is at or adjacent to the fully open position; moving a bumper into contact with the window when the window is detected as being at or adjacent to the fully open position; and moving the bumper out of contact with the window when the window is moved away from being at or adjacent to the fully open position.

An advantage of an embodiment is that the window glass in the vehicle door is stabilized in the full down position, while maintaining good sound quality as the door is closed. The door glass down stop stabilizer assembly may be less expensive than other methods employed in the past to stabilize the window glass. Moreover, the glass stabilization may be integrated into a window regulator, with a potential to possibly eliminate the need for below belt glass run channels.

DETAILED DESCRIPTION

Figure 1:
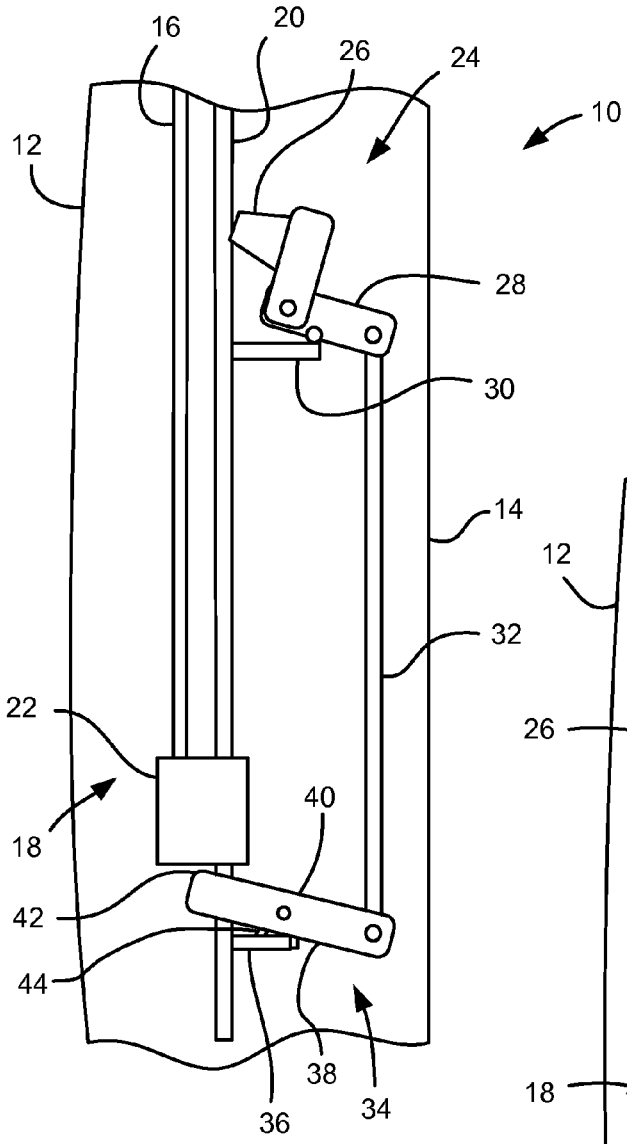
FIG. 1 is a schematic side view of a vehicle door having a movable window glass in a partially open (down) position.
Figure 2:
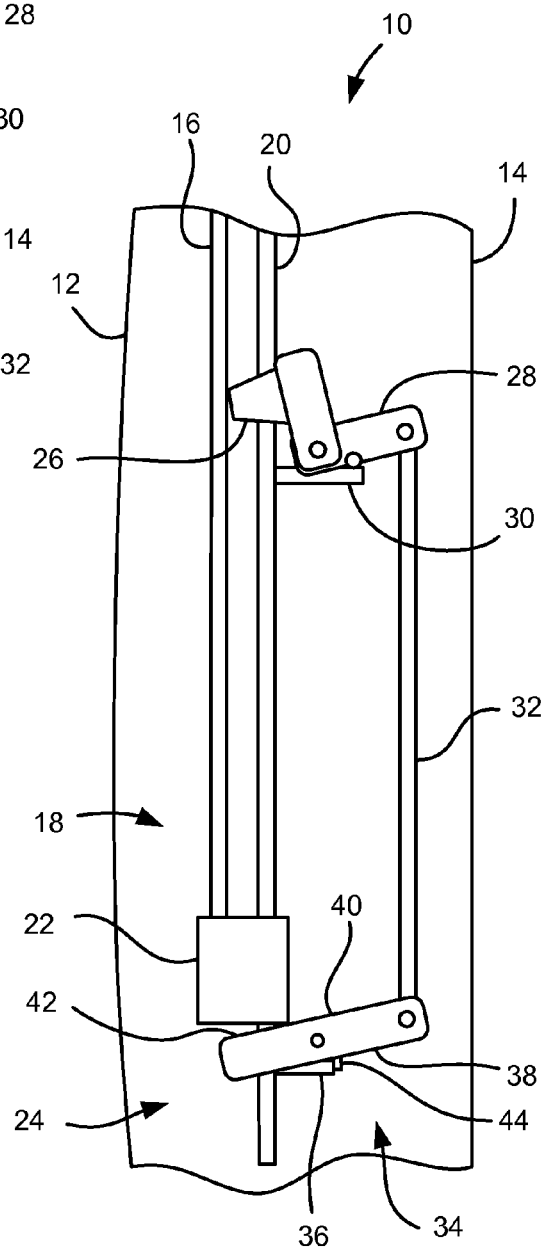
FIG. 2 is a view similar to FIG. 1, but illustrating the window glass in the fully open (full down) position.

Referring to FIGS. 1-2, a vehicle door, indicated generally at 10, is shown. The vehicle door 10 includes and outer panel 12 and an inner panel 14, within which a window glass 16 slides up and down. When referring to a glass window herein, the window of course can be made of materials other than glass, such as, for example, plastic. The up and down movement of the window 16 is controlled by a window regulator 18, which includes one or more regulator rails 20 upon which regulator sliders 22 that are attached to the window 16 slide. The regulator rails 20 are fixed relative to the door 10, and the regulator sliders 22 push and pull the window 16 up and down as they are driven along the regulator rails 20.

Also mounted in the door 10 is a glass down stop stabilizer assembly 24. The stabilizer assembly 24 may be mounted on one of the regulator rails 20. As an alternative, the stabilizer assembly 24 may be mounted to the door 10 instead if so desired.

The stabilizer assembly 24 includes a bumper 26 mounted to a bell crank assembly 28 that is pivotally mounted to an upper flange 30 extending from the regulator rail 20. A rod 32 extends from the bell crank assembly 28 down to a lower pivot assembly 34, which is pivotally mounted to a lower flange 36 extending from the regulator rail 20. The lower pivot assembly 34 includes a lever 38, which has the rod 32 pivotally attached at one end, a mid-section 40 that pivotally mounts to the lower flange 36 and a slider contact 42 at the opposite end. A clock spring 44, or other biasing means, may be employed for biasing the bumper to a position where it is pivoted away from the window 16.

The operation of the stabilizer assembly 24 of FIGS. 1 and 2 will now be discussed. When the window regulator 18 is activated, the regulator slider 22 slides downward along the regulator rail 20 pulling the window 16 downward with it. While the window 16 is in one of its full or partially closed positions, the slider 22 is not in contact with the lever 38. Consequently, the clock spring 44 (or other biasing means) will bias the lever in the clockwise direction (as viewed in FIGS. 1 and 2), which causes the rod 32 to pull downward on the bell crank assembly 28. This will cause the bumper 26 to remain pivoted away from the window 16. The bumper 26 remains in this position for almost the full motion of window opening.

FIG. 1 illustrates the window position when it is almost fully open. In this position, the regulator slider 22 is moving downward just before it contacts the slider contact 42 of the lever 38. As the window 16 continues moving downward, the regulator slider 22 will contact the slider contact 42 and begin to rotate the lever 38 counterclockwise against the bias of the clock spring 44. As the lever 38 rotates counter-clockwise, the rod 32 will push up on a first end of the bell crank assembly 28, causing the bumper 26 to pivot toward the window 16. As the regulator slider 22 (and window 16) reaches its full down position, the down stop stabilizer assembly 24 will cause the bumper 26 to press against the window 16 (as seen in FIG. 2). The outboard acting force of the bumper 26 against the window 16 will hold the window 16 firmly in position—thus, the window 16 is stabilized in its full down position. The bumper 26 material and positioning can be tuned to optimize the outboard acting force and optimize the damping of the window 16.

Figure 3:
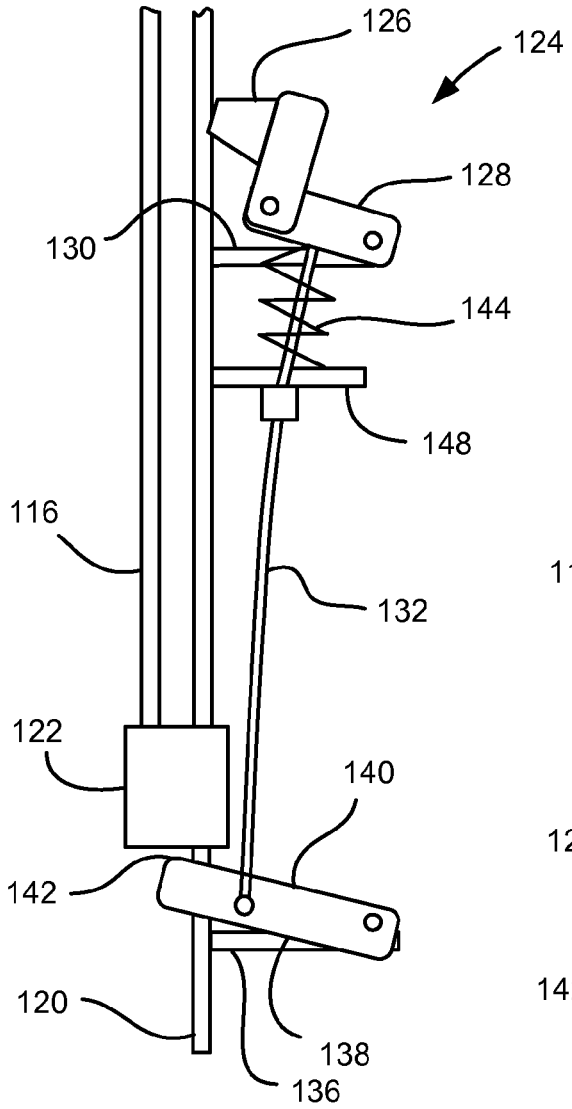
FIG. 3 is a view similar to FIG. 1, but illustrating a second embodiment.
Figure 4:
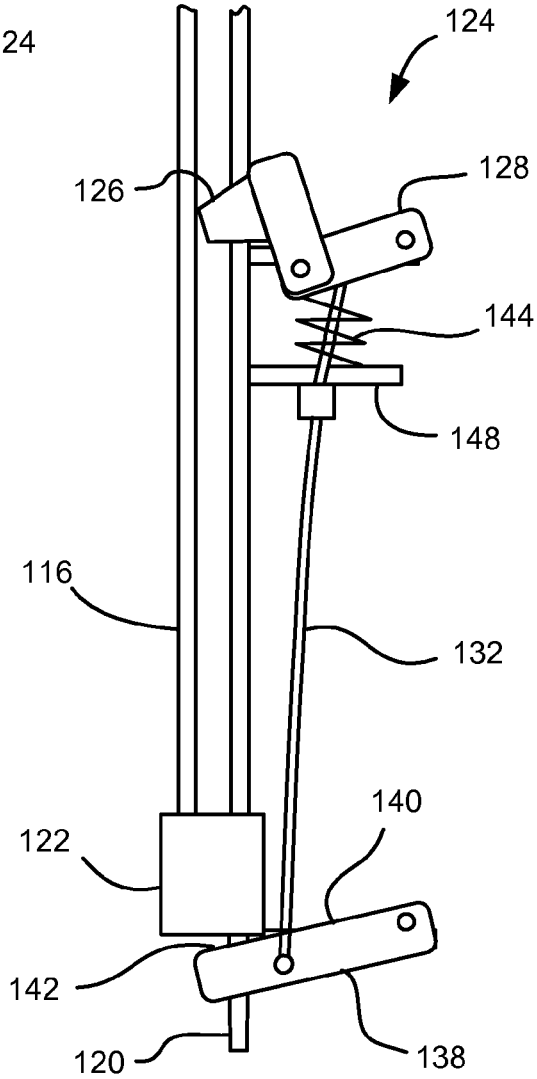
FIG. 4 is a view similar to FIG. 2, but illustrating the second embodiment.

FIGS. 3 and 4 illustrate a second embodiment. Since this embodiment is similar to the first, similar element numbers will be used for similar elements, but employing 100-series numbers. In this embodiment, again a regulator slider 122 slides on a regulator rail 120, pushing and pulling the window glass 116 up and down.

The glass down stop stabilizer assembly 124 is changed somewhat from the first embodiment. A cable 132 now attaches to a mid-section 140 of a lever 138 between a first end of the lever 138, which is pivotally attached to a lower flange 136 extending from the regulator rail 120, and a slider contact 142 near a second end of the lever 138. A bell crank assembly 128 supports a bumper 126 and is pivotally supported by an upper flange 130 extending from the regulator rail 120. Also, an intermediate flange 148 extends from the regulator rail 120. The intermediate flange 148 supports the cable 132 and also supports a compression spring 144 that biases the clock spring assembly in a clockwise direction (as seen in FIGS. 3 and 4) and, hence, the bumper 126 away from the window 116.

The operation of the stabilizer assembly 124 is similar to that of the first embodiment, except that, as the regulator slider 122 contacts the slider contact 142 of the lever 138, the lever 138 pulls down on the cable 132 to cause movement of the bumper 126 toward contact with the window 11 6. FIG. 3 shows the position of the regulator slider 122 just prior to contact with the lever 138, with the window pulled most of the way down toward a fully open position. FIG. 4 shows the position of the regulator slider 122 when the window 116 is in the full down (open) position. In this position, the stabilizer assembly 124 causes the bumper 126 to exert an outboard acting force against the window 116, thus stabilizing the window 116.

Figure 5:
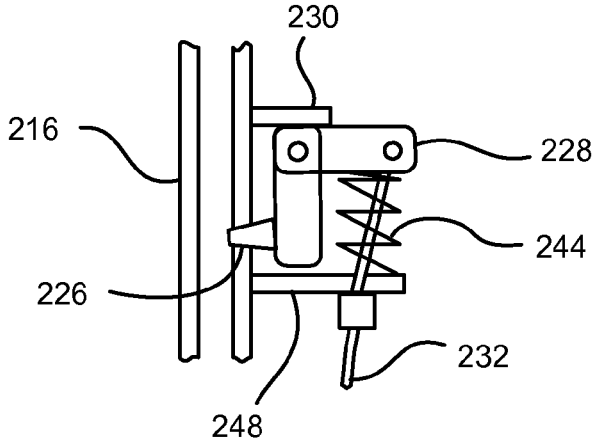
FIG. 5 is a schematic view of a portion of a vehicle door according to a third embodiment.

FIG. 5 illustrates a third embodiment. Since this embodiment is similar to the second, similar element numbers will be used for similar elements, but employing 200-series numbers. In this embodiment, the bumper 226 and bell crank assembly 228 are located on the underside of the upper flange 230 so that, when the cable 232 is pulled, the bell crank assembly 228 will rotate about a different point to cause the bumper 226 to contact the window 216. The compression spring 244 may still be supported by an intermediate flange 248 for biasing the bumper 226 away from the window 216.

Figure 6:
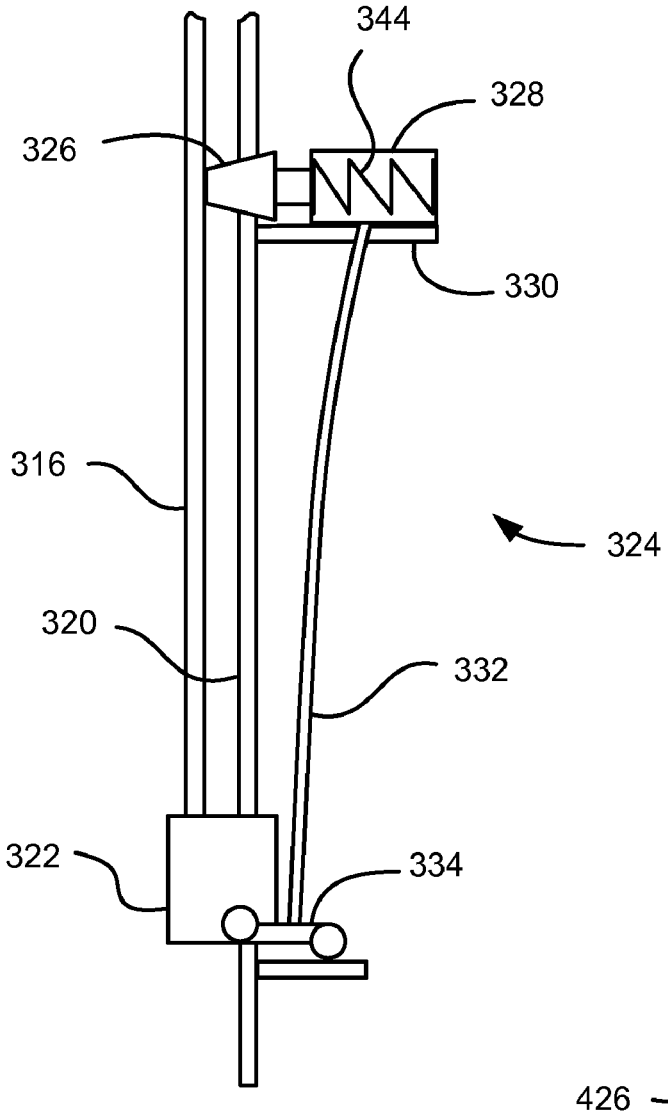
FIG. 6 is a view similar to FIG. 2, but illustrating a fourth embodiment.

FIG. 6 illustrates a fourth embodiment. Since this embodiment is similar to the first, similar element numbers will be used for similar elements, but employing 300-series numbers. In this embodiment, an electrical rather than mechanical means is used to actuate the glass down stop stabilizer assembly 324 and move the bumper 326 into engagement with the window 316.

The regulator slider 322 still slides along the regulator rail 320 and moves the window 316 with it. However, when the slider 322 reaches its bottom most location (i.e., full window open position), the slider 322 contacts a switch 334. The switch 334 is connected to an electronic actuator 328 via a wire harness 332. When the slider 322, which is mounted on an upper flange 330, is in contact with the switch 334, the electronic actuator 328 is activated, causing the bumper 326 to slide into contact with and stabilize the window 316. A spring 344 may be provided in the electronic actuator 328 so that, when the slider moves out of contact with the switch 334, the electronic actuator 328 is deactivated, allowing the spring 344 to retract the bumper 326 away from the window 316.

Figure 7:
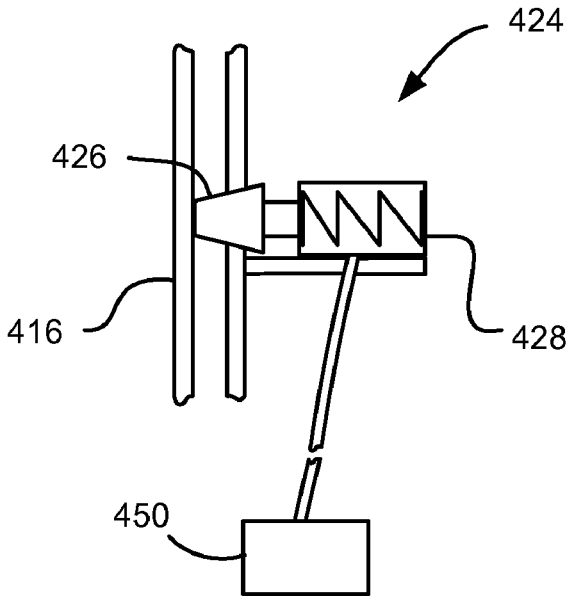
FIG. 7 is a view similar to FIG. 5, but illustrating a fifth embodiment.

FIG. 7 illustrates a fifth embodiment. Since this embodiment is similar to the fourth, similar element numbers will be used for similar elements, but employing 400-series numbers. This embodiment again depicts an electronic means to actuate the glass down stop stabilizer assembly 424 and move the bumper 426 into engagement with the window 416. Rather than a switch detecting a full open position of the window, though, a smart motor 450 is used to cause the up and down motion of the window 416. The smart motor 450 can detect the position of the window 416 by tracking the motion of the motor 450. An electronic actuator 428 is in electronic communication with the smart motor 450 and will be activated when the motor 450 detects that the window 416 is in its full down position. Activation of the electronic actuator 428 will cause the bumper 426 to slide into contact with the widow 416, stabilizing the window 416.

While certain embodiments of the present invention have been described in detail, those familiar with the art to which this invention relates will recognize various alternative designs and embodiments for practicing the invention as defined by the following claims.

What is claimed is:

1. A method of stabilizing a window in a vehicle door when the window is in a fully open position, the window having a bottom edge and a pair of sides extending upward from the bottom edge, the method comprising the steps of:

(a) moving the window toward a fully open position;

(b) detecting when the window is at or adjacent to the fully open position;

(c) moving a bumper into contact with one of the sides of the window at a location spaced from the bottom edge when the window is detected as being at or adjacent to the fully open position; and (d) moving the bumper out of contact with the window when the window is moved away from being at or adjacent to the fully open position.

2. The method of claim 1 wherein step (b) is further defined by monitoring a position of a motor that causes the window to move up and down, and determining a window position based on the position of the motor.

3. The method of claim 1 wherein step (c) is further defined by actuating an electronic actuator that telescopically slides the bumper into contact with the window.

4. The method of claim 1 wherein step (b) is further defined by positioning a switch to be contacted by a regulator slider when the window is at or adjacent to the fully open position.

5. The method of claim 1 wherein step (b) is further defined by moving the window with a regulator slider, and engaging the regulator slider with a lever that is pivotally mounted to a regulator rail, causing the lever to pivot when the window is at or adjacent to the fully open position.

6. The method of claim 5 wherein step (c) is further defined by connecting a rod between the lever and a bell crank that supports the bumper, and transferring a pivoting motion of the lever to the bell crank via the rod to thereby move the bumper into contact with the window.

7. The method of claim 5 wherein step (c) is further defined by connecting a cable between the lever and a bell crank that supports the bumper, and transferring a pivoting motion of the lever to the bell crank via the cable to thereby move the bumper into contact with the window.

8. The method of claim 1 wherein step (d) is further defined by providing a spring that biases the bumper away from the window.

* * * * *